US009114499B2

(12) United States Patent
Zhang et al.

(10) Patent No.: US 9,114,499 B2
(45) Date of Patent: Aug. 25, 2015

(54) WORKING TOOL

(71) Applicant: Shanghai Ken Tools Co., Ltd., Shanghai (CN)

(72) Inventors: Miao Zhang, Shanghai (CN); Guiren Liu, Shanghai (CN)

(73) Assignee: SHANGHAI KEN TOOLS CO., LTD., Shanghai (CN)

( * ) Notice: Subject to any disclaimer, the term of this patent is extended or adjusted under 35 U.S.C. 154(b) by 7 days.

(21) Appl. No.: 14/352,173

(22) PCT Filed: Sep. 25, 2012

(86) PCT No.: PCT/CN2012/081922
§ 371 (c)(1),
(2) Date: Apr. 16, 2014

(87) PCT Pub. No.: WO2014/032347
PCT Pub. Date: Mar. 6, 2014

(65) Prior Publication Data

US 2014/0349556 A1 Nov. 27, 2014

(30) Foreign Application Priority Data

Aug. 28, 2012 (CN) ..... 2012 1 0311163

(51) Int. Cl.
*B24B 23/02* (2006.01)
*B24B 55/05* (2006.01)
(Continued)

(52) U.S. Cl.
CPC ..... *B24B 23/028* (2013.01); *B24B 9/00* (2013.01); *B24B 23/00* (2013.01); *B24B 55/05* (2013.01); *B24B 55/052* (2013.01); *B25F 5/02* (2013.01)

(58) Field of Classification Search
CPC ..... B24B 23/028; B24B 23/00; B24B 23/02; B24B 55/05; B24B 55/052; B25F 5/02
USPC ..... 451/359, 358, 344
See application file for complete search history.

(56) References Cited

U.S. PATENT DOCUMENTS 6,120,362 A * 9/2000 Etter et al. ..... 451/354
8,480,453 B2 * 7/2013 Kobayashi ..... 451/11
(Continued)

FOREIGN PATENT DOCUMENTS

CN 201401363 Y 2/2010
CN 201889718 U 7/2011
(Continued)

*Primary Examiner* — Robert Rose
(74) *Attorney, Agent, or Firm* — Muncy, Geissler, Olds & Lowe, P.C.

(57) ABSTRACT

A working tool includes a housing (10) and a lever (3) having a gap defined therein for accommodating a rotatable switch lock (1). The switch lock has a first engagement portion (1*a*) defined on a first side and a stopper portion (1*b*) defined on a second side, and the lever has a support portion (3*a*) proximal to the first engagement portion. A handle portion of the housing has a left push button (8) and a right push button (5) inserted therein, a first groove (8*a*) and a second groove (8*b*) of the left push button (8) and right push button (5) each having a second engagement portion formed on a groove wall thereof, each of a first extension section (3*a*-2) and second extension sections (3*a*-1) being provided with, at a side facing a corresponding second engagement portion, a third engagement portion engageable with the corresponding second engagement portion. The working tool is capable of reducing operation mistakes as much as possible, preventing inadvertent shutdown of the motor, and allowing any operator, no matter left-handed or right-handed, to operate it conveniently.

8 Claims, 21 Drawing Sheets

(51) Int. Cl.

| | |
|---|---|
| ***B25F 5/02*** | (2006.01) |
| ***B24B 23/00*** | (2006.01) |
| ***B24B 9/00*** | (2006.01) |

(56) References Cited

U.S. PATENT DOCUMENTS

| | | | | |
|---|---|---|---|---|
| 2008/0090504 | A1* | 4/2008 | Trautner et al. | 451/359 |
| 2011/0168422 | A1* | 7/2011 | Fujiwara et al. | 173/217 |
| 2011/0227429 | A1* | 9/2011 | Takeda et al. | 310/50 |
| 2013/0316626 | A1* | 11/2013 | Yaschur et al. | 451/344 |
| 2014/0338947 | A1* | 11/2014 | Boeck et al. | 173/170 |

FOREIGN PATENT DOCUMENTS

| | | | |
|---|---|---|---|
| CN | 102171005 | A | 8/2011 |
| EP | 2 345 510 | A2 | 7/2011 |
| WO | WO 2010/026963 | A1 | 3/2010 |

* cited by examiner

WORKING TOOL

TECHNICAL FIELD

The present invention relates to a portable electric angle grinder for use in grinding or polishing a workpiece.

BACKGROUND

An ordinary electric angle grinder typically includes: a housing; a working mechanism disposed on a head portion of the housing and configured to grind or polish a workpiece; a motor disposed within the housing and configured to drive the working mechanism; a switch disposed within a handle portion of the housing and configured to activate or deactivate the motor; and a lever disposed right under the switch and configured to allow an operator to operate the switch in the housing through manipulating the lever. Once the motor is switched on, a grinding wheel of the working mechanism starts to rotate at a very high speed, during which, if the operator improperly operates the tool or is unfamiliar with the tool, the grinding wheel rotating at a very high speed might lead to body injury. For this reason, the grinder generally further includes a lock means disposed in proximity of the lever in order to prevent operation mistakes as much as possible.

Examples in this regard include a working tool as disclosed in PCT App. No. PCT/JP2009/065259, entitled "Working Tool". In one embodiment, the working tool is an electric angle grinder including: a motor for driving a grinding wheel to grind or polish a workpiece; a motor housing for housing the motor, the motor housing having a portion defining a handle; a wheel guard coupled to a rear portion of the motor housing, at a location opposite to where the grinding wheel is mounted; a lever adapted to be operated by an operator by hand, the lever having a strip shape and being disposed above both the motor housing and wheel guard; and a switch disposed within the wheel guard and connected to the lever via an opening. The motor can be activated or deactivated by a manipulation to the lever by the operator.

In order to prevent operation mistakes, the electric angle grinder further includes a lock means disposed on the lever. The lock means includes a rotating shaft, an engagement portion and a manipulation portion. The principle of the lock means is that when the lock means is in a locked state, the engagement portion engages with a protrusion of the lever with the aid of an elastic force exerted by a spring, and the operator, thus, cannot operate the lever any more. To activate the motor to initiate the grinding or polishing operation of the grinding wheel, the operator needs to operate, with one hand, the manipulation portion with a force exceeding the elastic force of the spring so as to cause the lock means to rotate and the engagement portion to gradually detach from the protrusion of the lever. After the engagement portion becomes disengaged from the protrusion portion, the operator further needs to push the lever upwards, with the other hand, to switch on the switch. Moreover, in order to prevent a restoring force of the switch from causing the engagement portion of the lock means to re-engage with the protrusion of the lever and thus shutting down the motor, the operator further needs to always press the lever throughout the whole process of the grinding or polishing operation.

As indicated in the foregoing description, although this lock means facilitates mistaken operation prevention, it leads to disadvantages such as increase of the operator's physical workload, reduction of operational efficiency, and possible occurrence of undesirable motor shutdown.

SUMMARY OF THE INVENTION

Accordingly, it is an objective of the present invention to provide an electric angle grinder capable of reducing the operator's physical workload and improving operational efficiency and suitable for use by both left-hand and right-hand operators.

In order to achieve the foregoing objective, one aspect of the present invention provides a working tool which includes: a housing; a working mechanism disposed on a working portion of the housing and configured to grind or polish a workpiece, the working mechanism driven to work by a motor disposed within the housing; a switch disposed within a handle portion of the housing and configured to activate or deactivate the motor; and a lever disposed under the switch and having a first end connected to the housing, wherein the lever has a gap formed therein for accommodating a switch lock, the switch lock having a rotating shaft inserted therethrough, the rotating shaft having two ends both connected to the lever and surrounded by a torsion spring, the switch lock including a first portion extending out of the lever and a second portion hiding in the housing, wherein the second portion of the switch lock has a first engagement portion defined on a first side and a stopper portion defined on a second side thereof, the lever having a support portion proximal to and engageable with the first engagement portion, wherein the handle portion of the housing has a left push button and a right push button partially inserted therein from a left side and a right side, respectively, the left push button and the right push button each having a first end horizontally protruding out of the housing to act as a manipulation portion and a main body and a second end hiding in the housing, the second end of the left push button slidably fitting in the second end of the right push button to allow the left push button to move horizontally towards the right push button and the right push button to move horizontally towards the left push button, the second ends of the left push button and right push button having a reset mechanism interconnected therebetween, wherein the main bodies of the left push button and the right push button in the housing are formed with a first groove and a second groove, respectively, the lever having a first extension section and a second extension section formed at a second end thereof in correspondence with the positions of the first groove and the second groove, respectively, the first extension section and the second extension section extending in the first groove and the second groove, respectively, each of the first groove and the second groove having a second engagement portion formed on a groove wall thereof, each of the first extension section and the second extension section being provided with, at a side facing a corresponding second engagement portion, a third engagement portion engageable with the corresponding second engagement portion, wherein when the working tool is in a locked state, the first engagement portion engages with the support portion, the stopper portion being pushed against a fixation member disposed in the housing, each second engagement portion being disengaged from the corresponding third engagement portion, and wherein when the working tool is in an unlocked state, the first engagement portion is disengaged from the support portion, the stopper portion being apart from the fixation member, the second engagement portion on the first groove engaging with the third engagement portion on the first extension portion or the second engagement portion on the second groove engaging with the third engagement portion on the second extension portion.

Preferably, the second end of the left push button may define third extension sections each formed with a first sliding groove, and the second end of the right push button may define fourth extension sections each formed with a second sliding groove, wherein each of the third extension sections has an end portion horizontally slidably disposed in a corresponding second sliding groove, and each of the fourth extension sections has an end portion horizontally slidably disposed in a corresponding first sliding groove, wherein the end portions of the third extension sections and the end portions of the fourth extension sections are hooked up when the working tool is in a locked state, and the reset mechanism is disposed in a space defined by the third extension sections and the fourth extension sections.

Preferably, the reset mechanism may include a reset spring and a protrusion extending from a central area of the second end of the left push button towards the right push button, wherein the reset spring surrounds the protrusion.

Preferably, the working mechanism may include a grinding wheel and a guard securing means disposed spacedly around the grinding wheel; the grinding wheel may be driven to rotate by the motor, wherein the guard securing means may include a guard disposed around the grinding wheel and a front cover coupled to the housing; the guard may be provided a snap ring axially extending from a surface thereof opposite to the grinding wheel in a direction departing from the grinding wheel; the snap ring may be formed with one or more protrusions on the inner surface, and a top portion of the front cover defines one or more recesses, a number of which is equal to a number of the one or more protrusions; the front cover may define an outer circumstantial surface formed with an annular groove, and the one or more protrusions of the snap ring may fit in the annular groove with an aid of the one or more recesses of the front cover; the snap ring and the front cover may sandwich a portion of a wrench and leave a hanging tongue of the wrench outside; the snap ring may be formed with stop notches, and the portion of the wrench sandwiched between the snap ring and the front cover may be formed with a stop cog engaging with one of the stop notches.

Another aspect of the present invention provides a working tool, which includes: a working mechanism disposed on a working portion of the housing and configured to grind or polish a workpiece, the working mechanism driven to work by a motor disposed within the housing; a switch disposed within a handle portion of the housing and configured to activate or deactivate the motor; and a lever disposed under the switch and having a first end connected to the housing, wherein the lever has a gap formed therein for accommodating a switch lock, the switch lock having a resilient shaft inserted therethrough, the resilient shaft having two ends both connected to the lever and surrounded by a torsion spring, the switch lock including a first portion extending out of the lever and a second portion hiding in the housing, wherein the second portion of the switch lock has a first engagement portion defined thereon, and the lever has a support portion proximal to and engageable with the first engagement portion, wherein the handle portion of the housing has a left push button and a right push button partially inserted therein from a left side and a right side, respectively, the left push button and the right push button each having a first end horizontally protruding out of the housing to act as a manipulation portion and a main body and a second end hiding in the housing, the second end of the left push button slidably fitting in the second end of the right push button to allow the left push button to move horizontally towards the right push button and the right push button to move horizontally towards the left push button, the second ends of the left push button and right push button having a reset mechanism interconnected therebetween, wherein the left push button has a first extension portion extending towards the lever and the right push button has a second extension portion extending towards the lever, the first extension portion having an end portion defining a fourth engagement portion and the second extension portion having an end portion defining a fifth engagement portion, the fourth engagement portion and the fifth engagement portion spacedly disposed opposing each other to form an engagement gap between the first extension portion and the second extension portion, the lever having a fifth extension section extending towards and partially inserted in the engagement gap, the fifth extension section having a sixth engagement portion in the engagement gap and engageable with the fourth engagement portion or the fifth engagement portion, wherein when the working tool is in a locked state, the first engagement portion engages with the support portion, and the sixth engagement portion is disengaged from both of the fourth engagement portion and the fifth engagement portion, and wherein when the working tool is in an unlocked state, the first engagement portion is disengaged from the support portion, and the sixth engagement portion engages with the fourth engagement portion or the fifth engagement portion.

Preferably, the housing and the lever may have a handle reinforcement plate formed therebetween and the handle reinforcement plate may be fixedly coupled to the lever.

Advantageously, the working tool of the present invention entails an electric angle grinder that can be locked to reduce operation mistakes as much as possible by employing a simple structure. Also advantageously, the electric angle grinder can be maintained in an unlocked state throughout an operation process without needing an operator to always press the lever, thereby reducing the operator's physical workload, improving operational efficiency, and preventing inadvertent shutdown of the motor. Still also advantageously, the design of the left and right push buttons allows any operator, no matter left-handed or right-handed, to operate the tool conveniently.

DETAILED DESCRIPTION

The present invention will become more readily apparent and better understood as the following detailed description of preferred embodiments of the invention is considered in connection with the accompanying drawings.

Embodiment 1

Figure 1A:
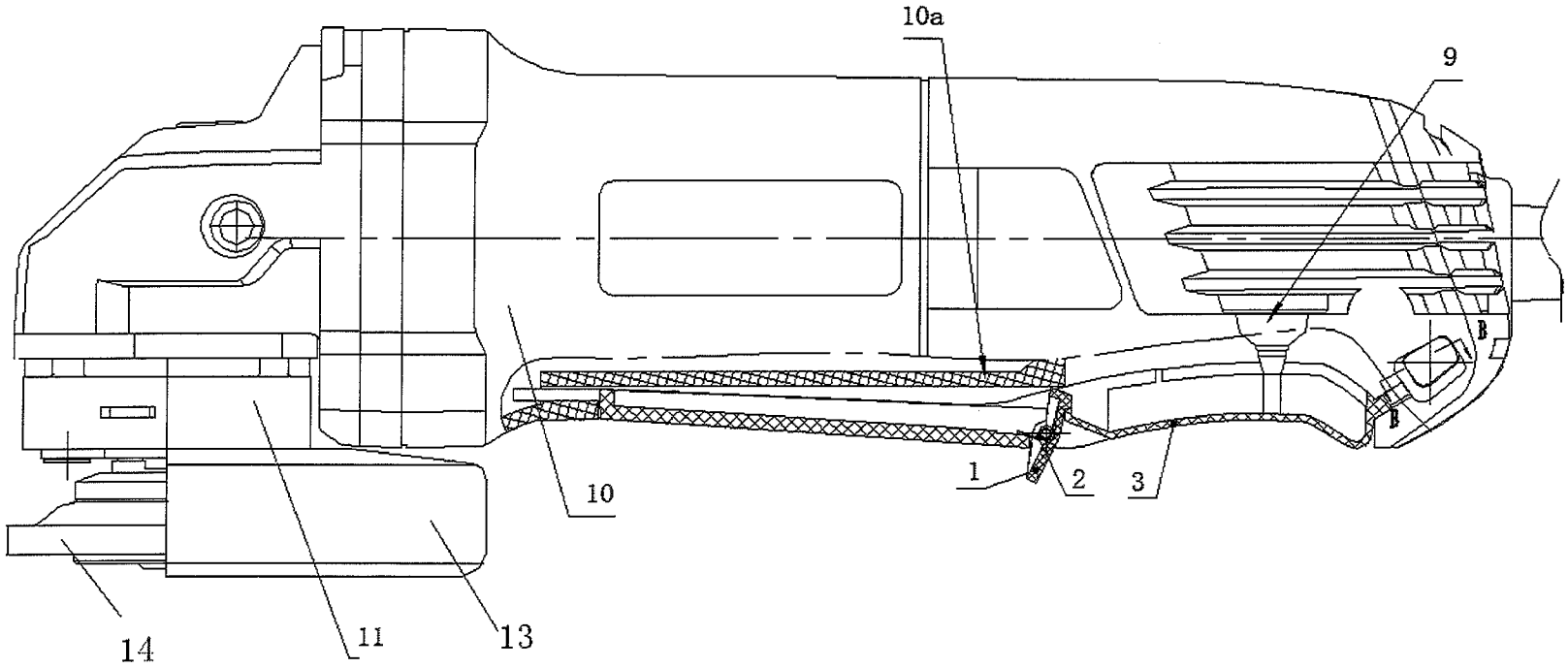
FIG. 1A is a partial schematic cross-sectional view illustrating a working tool in a locked state in accordance with Embodiment 1 of the present invention.
Figure 1B:
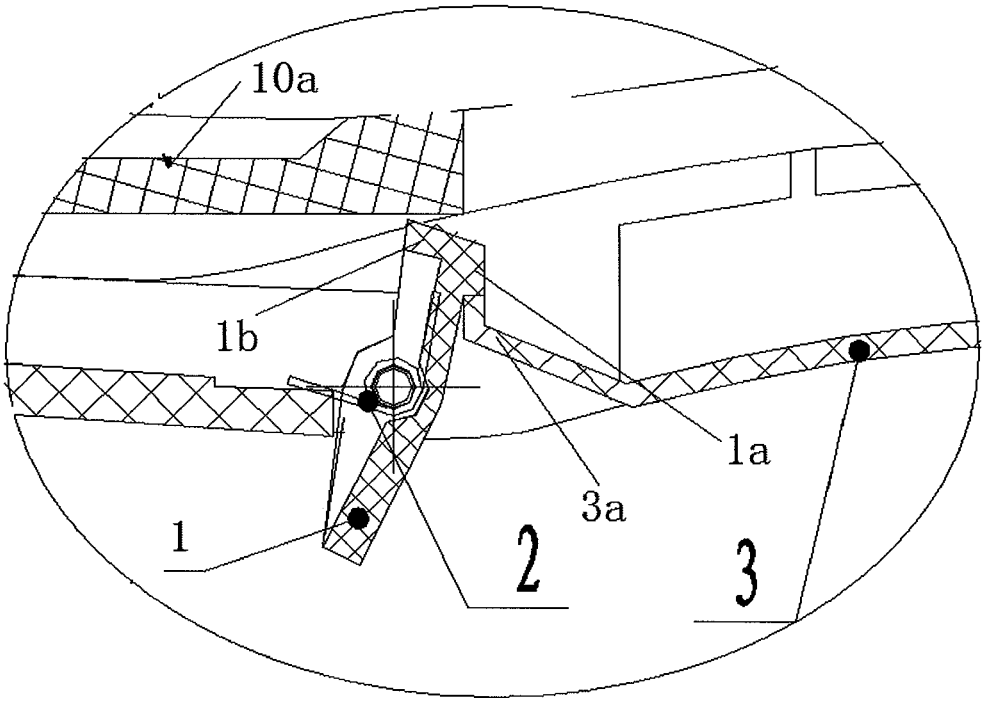
FIG. 1B is an enlarged view of part of FIG. 1A.
Figure 2:
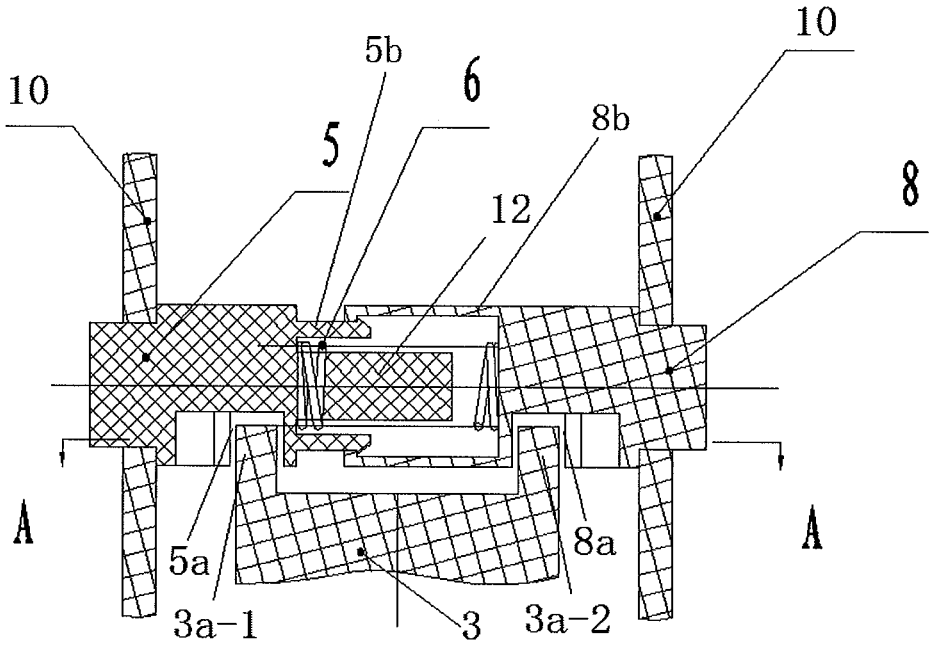
FIG. 2 is a cross-sectional view taken along line B-B of FIG. 1A.

Referring now to FIGS. 1A and 1B, the present embodiment discloses a working tool including a housing 10. A working mechanism 11 is disposed on a working portion of the housing 10 and configured to grind or polish a workpiece. In this embodiment, the working portion is located at the left end of the housing 10. The working mechanism 11 is driven to work by a motor disposed within the housing 10. A switch 9 is disposed within a handle portion of the housing 10. In this embodiment, the handle portion is located at the right end of the housing 10. The switch 9 is configured to activate or deactivate the motor. When the motor is activated, the working mechanism 11 is driven to grind or polish; or when the motor is deactivated, the working mechanism 11 stops its operation. A lever 3 is disposed under the switch 9 and has its left end connected to the housing 10. When an operator presses down the lever 3, the motor is activated. The lever 3 has a gap formed therein for accommodating a switch lock 1, and the switch lock is disposed in this gap. The switch lock 1 has a rotating shaft inserted through a middle portion thereof and the rotating shaft has its two ends both connected to the lever 3, thereby allowing the switch lock 1 to rotate about the rotating shaft. The rotating shaft is surrounded by a torsion spring 2. The switch lock 1 includes a first portion extending out of the lever 3 and a second portion hiding in the housing 10. The second portion of the switch lock 1 has a first engagement portion 1*a* extending outwardly on a right side thereof and a stopper portion 1*b* extending upwardly on a left side thereof. The lever 3 has a support portion 3*a* proximal to and engageable with the first engagement portion 1*a*. With further reference to FIG. 2, the handle portion of the housing 10 is provided with a left push button 8 and a right push button 5 partially inserted therein from the left and right sides, respectively. The left push button 8 and the right push button 5 each has a first end horizontally protruding out of the housing 10 to act as a manipulation portion and a rest portion including a main body and a second end hiding in the housing 10. The second end of the left push button 8 slidably fits in the second end of the right push button 5, thereby allowing the left push button 8 to move horizontally towards the right push button 5 and the right push button 5 to move horizontally towards the left push button 8.

In the present embodiment, the fitting between the second ends of the left and right push buttons may be accomplished by the following design. The second end of the left push button 8 defines third extension sections 8*b* each extending towards the right push button 5 and has a first sliding groove formed thereon. Similarly, the second end of the right push button 5 defines fourth extension sections 5*b* each extending towards the left push button 8 and has a second sliding groove formed thereon. Each of the third extension sections 8*b* has an end portion horizontally slidably disposed in a corresponding first sliding groove, and each of the fourth extension sections 5*b* has an end portion horizontally slidably disposed in a corresponding second sliding groove. The end portions of the third and fourth extension sections 8*b*, 5*b* can be hooked up when the working tool is in a locked state.

A reset mechanism is interconnected between the second ends of the left push button 8 and the right push button 5. As illustrated, the reset mechanism may be disposed in a space defined by the third extension sections 8*b* and fourth extension sections 5*b*. In the present embodiment, the reset mechanism includes: a reset spring 6 and a protrusion 12 extending from a central area of the second end of the left push button 8 towards the right push button 5, wherein the reset spring 6 surrounds the protrusion 12.

The main bodies of the left push button 8 and the right push button 5 in the housing 10 are formed with a first groove 8*a* and a second groove 5*a*, respectively. Correspondingly, the lever 3 has a first extension section 3*a*-2 and a second extension section 3*a*-1 formed at its right end in correspondence with the positions of the first and second grooves 8*a* and 5*a*, respectively. The first extension section 3*a*-2 and the second extension section 3*a*-1 extend in the first groove 8*a* and the second groove 5*a*, respectively. The first groove 8*a* has a second left engagement portion 8*c* formed on its groove wall and the second groove 5*a* has a second right engagement portion 5*c* formed on its groove wall. The first extension section 3*a*-2 is provided with, at a side facing the second left engagement portion 8*c*, a third left engagement portion 3*b*-1 engageable with the second left engagement portion 8*c*; and the second extension section 3*a*-1 is provided with, at a side facing the second right engagement portion 5*c*, a third right engagement portion 3*b*-2 engageable with the second right engagement portion 5*c*.

The working mechanism 11 of the present embodiment may include a grinding wheel 14 and a guard securing means 13 disposed spacedly around the grinding wheel 14. The grinding wheel 14 can be driven to rotate by the motor.

Figure 12A:
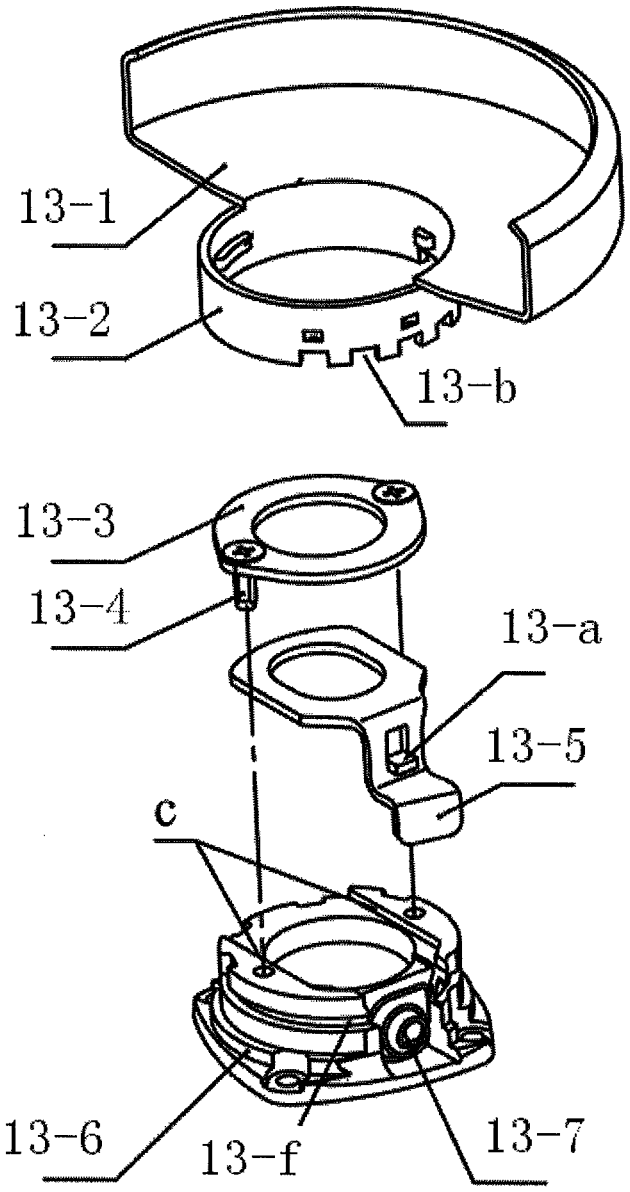
FIG. 12A is an exploded view of a guard securing means in accordance with the present invention.
Figure 12B:
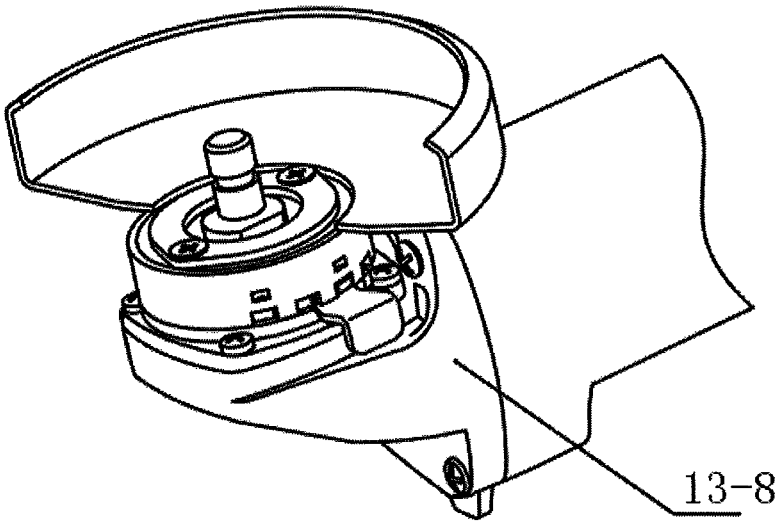
FIG. 12B is a diagram illustrating the guard securing means in accordance with the present invention after it is assembled.

Referring now to FIGS. 12A and 12B, the guard securing means 13 may include a guard 13-1 disposed around the grinding wheel 14 and a front cover 13-6 coupled to the housing 10. The guard 13-1 is provided with a snap ring 13-2 axially extending from a surface of the guard 13-1 opposite to the grinding wheel 14 in a direction departing from the grinding wheel 14. The snap ring 13-2 is formed with protrusions e1, e2, e3, e4, and e5 on the inner surface. Correspondingly, a top portion of the front cover 13-6 defines recesses g1, g2, g3, g4, and g5 for engaging with the respective protrusions. The front cover 13-6 defines an outer circumstantial surface formed with an annular groove 13-*f*, and the annular groove 13-*f* is also engageable with the protrusions. The snap ring 13-2 and the front cover 13-6 sandwich and fix a portion of a wrench 13-5 using an upper fixation plate 13-3 and screws 13-4 and leave a hanging tongue of the wrench 13-5 outside. The snap ring 13-2 is formed with stop notches 13-*b*, and the wrench 13-5 is formed with a stop cog 13-*a* for engaging with one of the stop notches 13-*b*. A spring 13-7 is disposed between the wrench 13-5 and an outer circumstantial surface of the front cover 13-6. The guard 13-1 and the snap ring 13-2 are integrated as a whole 13-8 by welding.

Figure 13A:
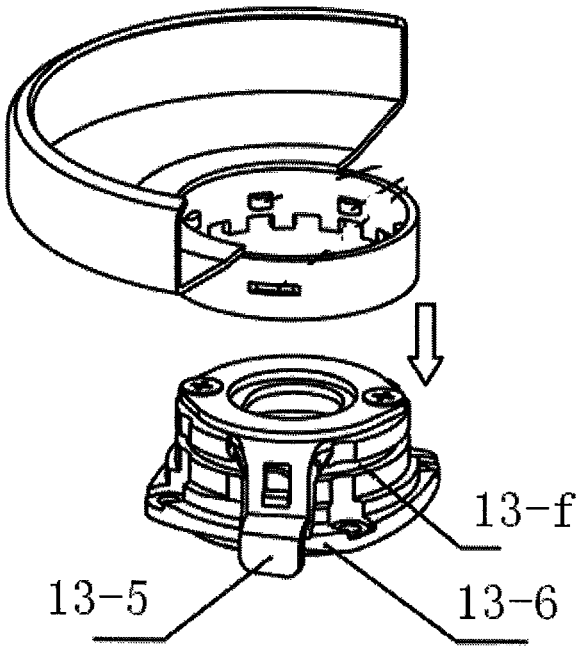
FIG. 13A schematically illustrates how the guard securing means in accordance with the present invention is assembled.
Figure 13B:
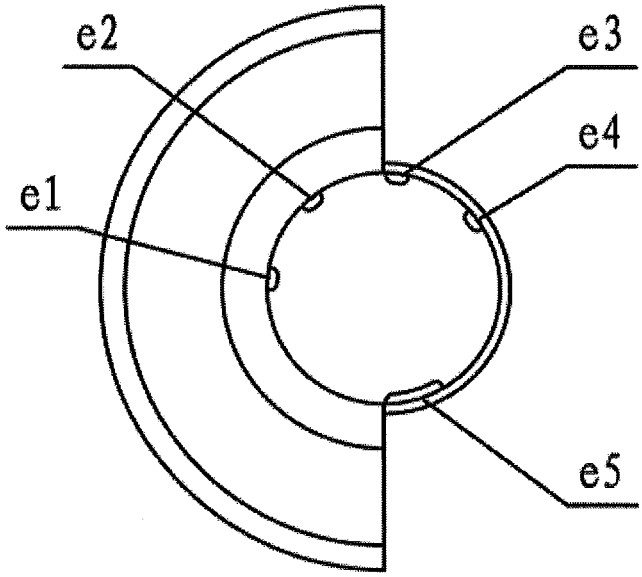
FIG. 13B depicts a guard having a snap ring formed thereon in accordance with the present invention.
Figure 13C:
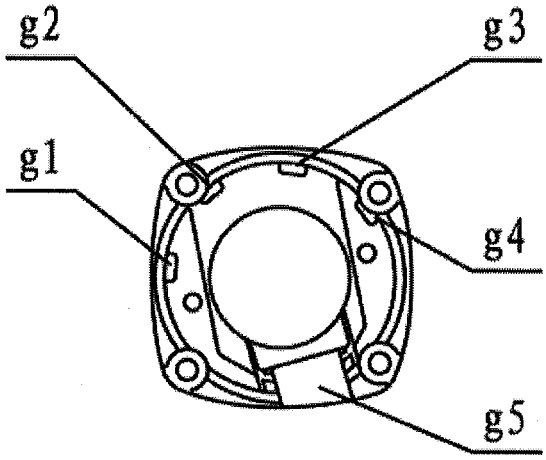
FIG. 13C depicts a front cover of the guard securing means in accordance with the present invention.
Figure 14A:
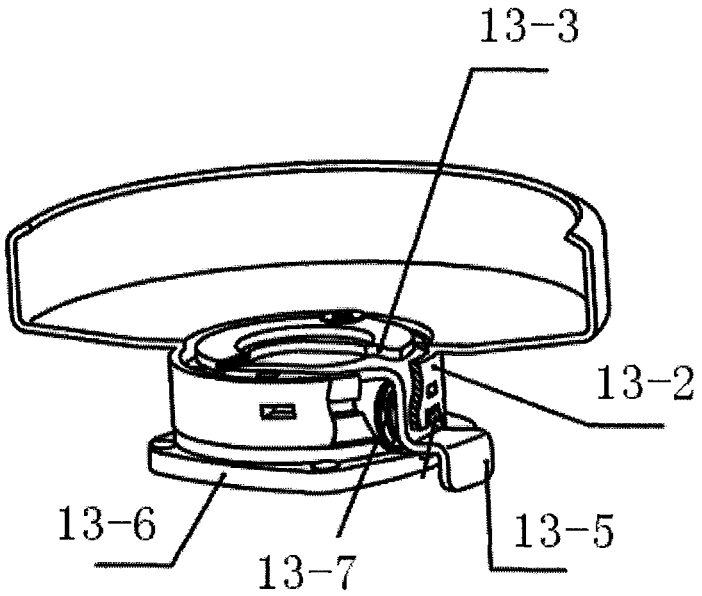
FIG. 14A depicts the guard securing means in a secured state in accordance with the present invention.
Figure 14B:
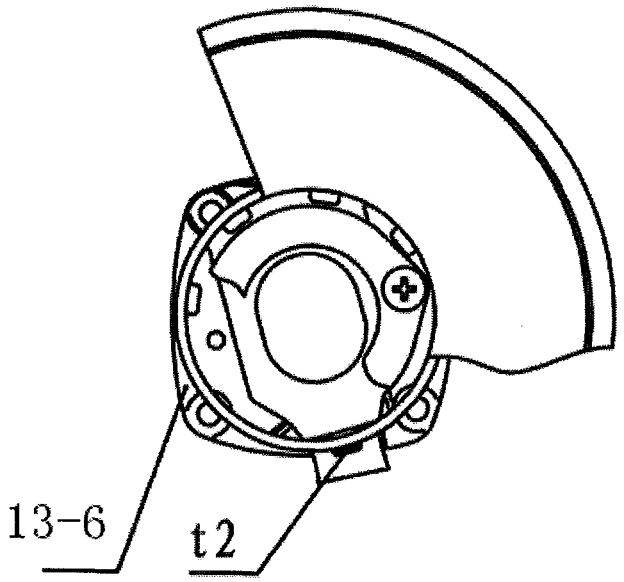
FIG. 14B is a top view of FIG. 14A in accordance with the present invention.
Figure 14C:
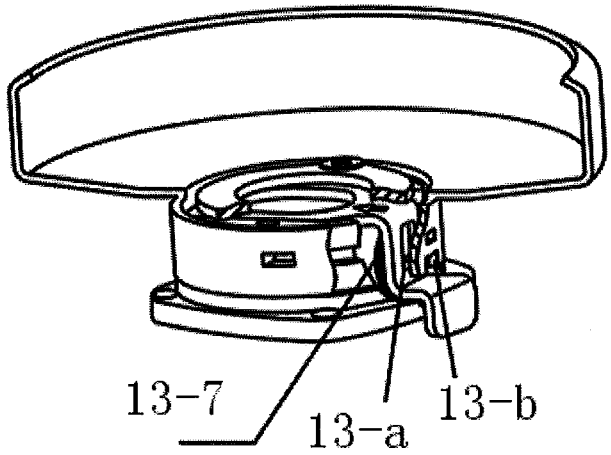
FIG. 14C schematically illustrates how the orientation of the guard of the guard securing means is adjusted.
Figure 14D:
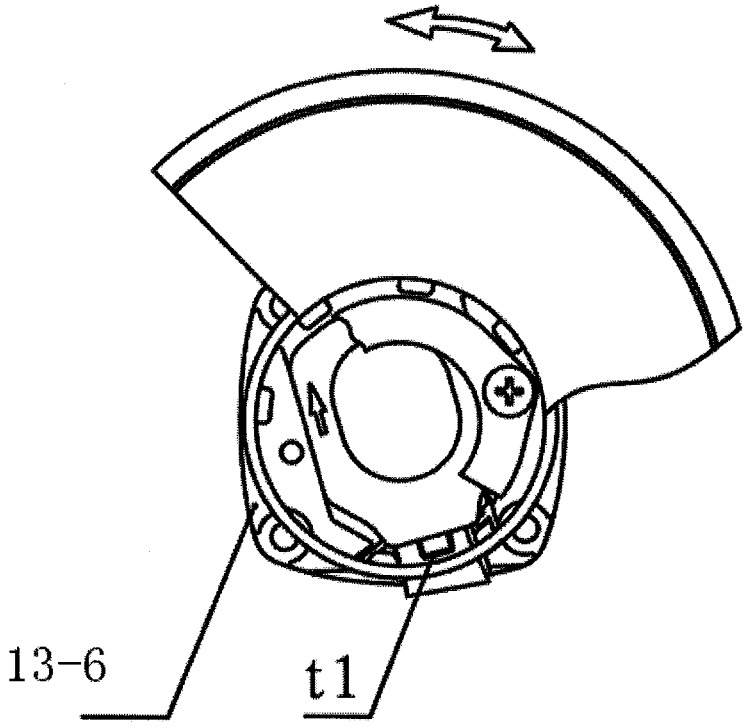
FIG. 14D is a top view of FIG. 14C.

Referring to FIGS. 13A to 13C, the assembly of the guard can be accomplished by following the steps of: pushing down the wrench 13-5; aligning the protrusions e1, e2, e3, e4, and e5 of the snap ring 13-2 with the corresponding recesses g1, g2, g3, g4, and g5 of the front cover 13-6 and fitting the guard to the front cover 13-6; rotating the guard until the protrusions of the snap ring 13-2 are received in the annular groove 13-*f* of the front cover 13-6; further rotating the guard to a desired position; and releasing the wrench 13-5 such that the stop cog 13-*a* of the wrench 13-5 is inserted into a corresponding stop notch 13-*b* of the snap ring 13-2, thereby preventing further rotation of the guard and finishing the assembly of the guard of the grinding wheel.

Referring to FIGS. 14A to 14D, the securing and orientation adjustment of the guard can be accomplished by following the steps of: pushing the wrench 13-5 to make it slide along a sliding channel formed by a counter groove 13-*c* of the front cover 13-6 and the upper fixation plate 13-3 (which is fixed to the front cover 13-6 using the screws 13-4), until the stop cog 13-*a* of the wrench 13-5 becomes disengaged from the corresponding stop notch 13-*b* of the snap ring 13-2 (refer to t1 of FIG. 14D); rotating the guard 13-1 until it is oriented at a desired angle; and after the guard 13-1 is adjusted in place, releasing the wrench 13-5, so that the spring 13-7 will exert an elastic force which pushes the stop cog 13-*a* into the corresponding stop notch 13-*b* (refer to t2 of FIG. 14B), thereby positioning the guard 13-1 and preventing its further rotation.

Figure 15:
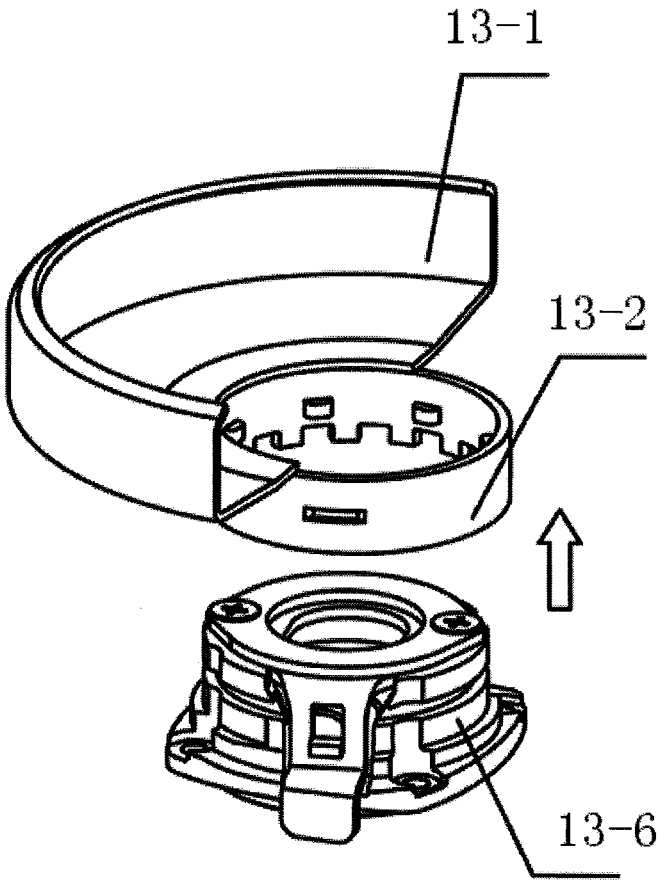
FIG. 15 depicts how the guard securing means in accordance with the present invention is disassembled.

Referring to FIG. 15, the guard can be detached by pressing down the wrench 13-5, rotating the guard 13-1 to a position corresponding to the front cover 13-6, taking the guard 13-1 out, and releasing the wrench 13-5.

Figure 3:
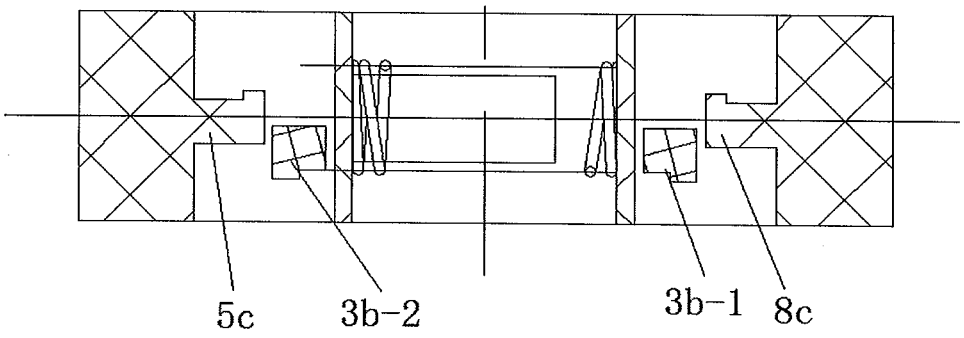
FIG. 3 is a cross-sectional view taken along line A-A of FIG. 2.

Referring back to FIG. 1B, when the working tool is in a locked state, the first engagement portion 1*a* firmly engages with the support portion 3*a* with the aid of the torsion spring 2, and the stopper portion 1*b* is pushed tightly against a fixation member 10*a* disposed in the housing 10. As such, an operator is unable to operate the lever 3. Moreover, with further reference to both FIG. 2 and FIG. 3, the end portions of the third and fourth extension sections 5*b*, 8*b* are hooked up, with the second left engagement portion 8*c* being disengaged from the third left engagement portion 3*b*-1 and the second right engagement portion 5*c* being disengaged from the third right engagement portion 3*b*-2.

Figure 4:
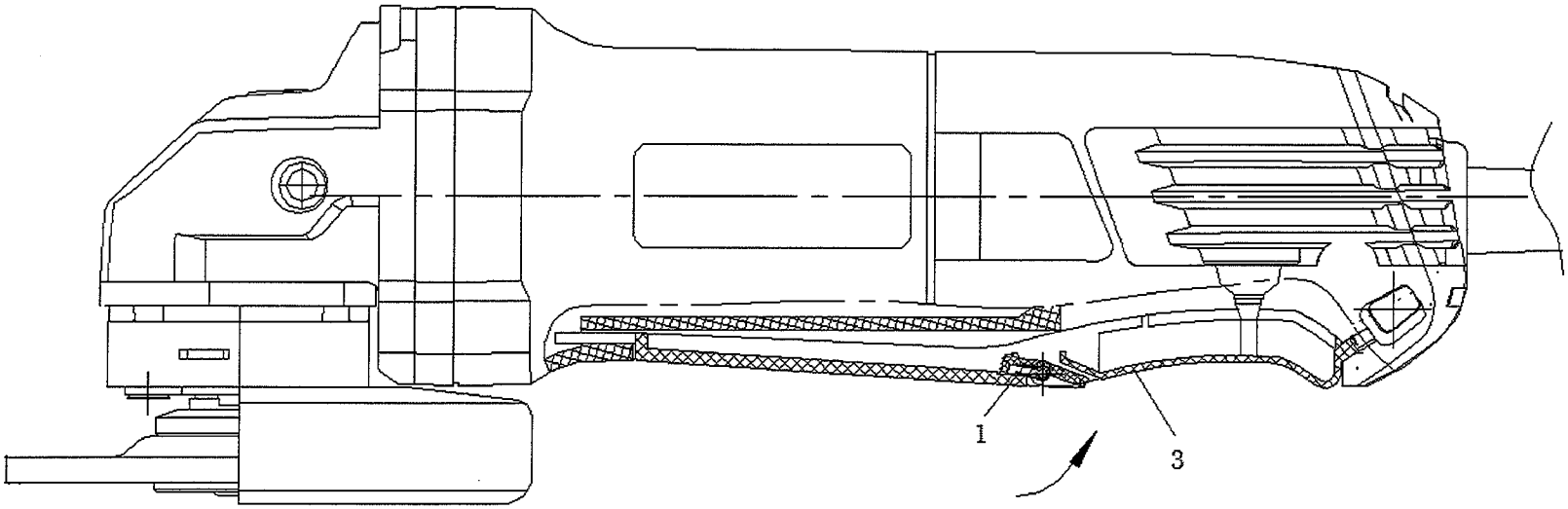
FIG. 4 depicts a partial schematic cross-sectional view illustrating a working tool of Embodiment 1 after a switch lock is turned counterclockwise.

When to unlock the working tool, an operator needs to first rotate the switch 1 in the counterclockwise direction (as indicated by the arrow in FIG. 4) with one hand to disengage the first engagement portion 1*a* from the support portion 3*a*, accompanied with the departure of the stopper portion 1*b* from the fixation member 10*a*. Generally, the left hand is used for a right-handed operator, and the right hand is used for a left-handed operator.

Figure 5:
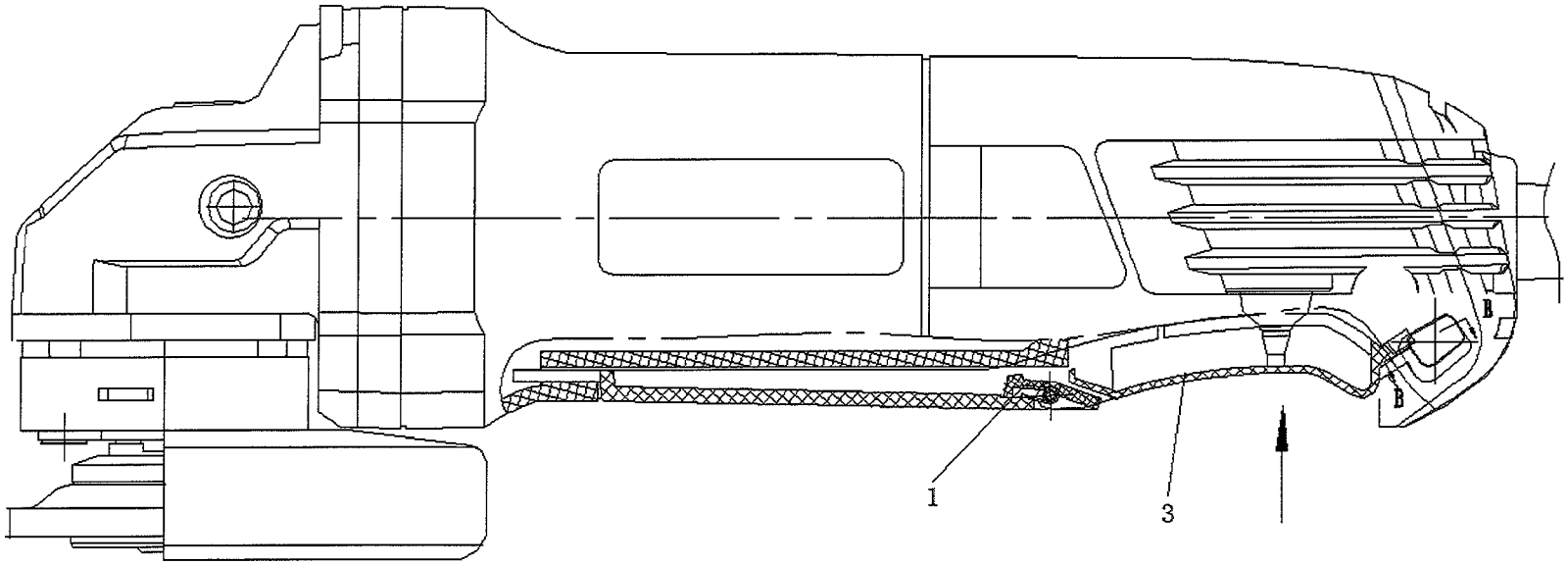
FIG. 5 depicts a partial schematic cross-sectional view illustrating a working tool of Embodiment 1 after a lever is pressed down.
Figure 6:
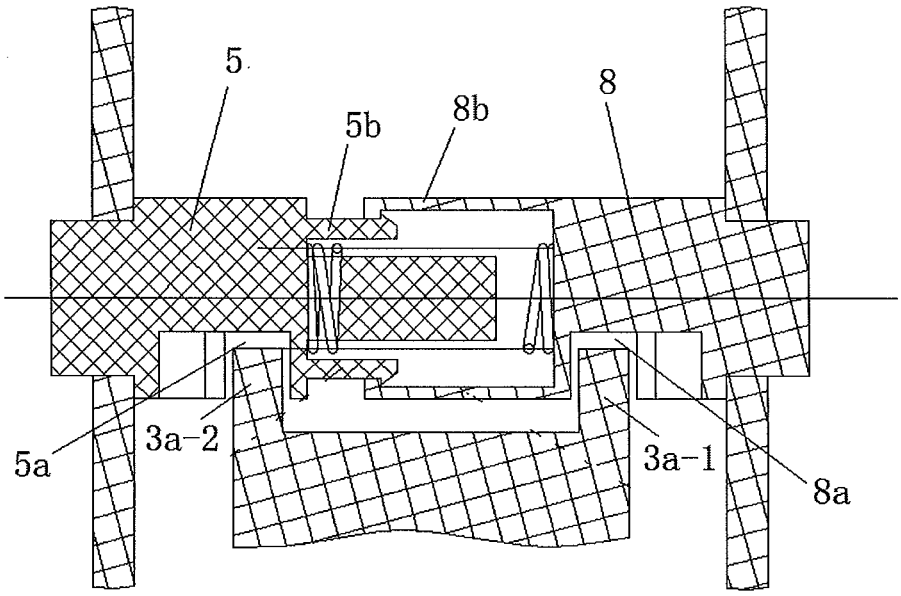
FIG. 6 is a cross-sectional view taken along line B-B of FIG. 5.
Figure 7:
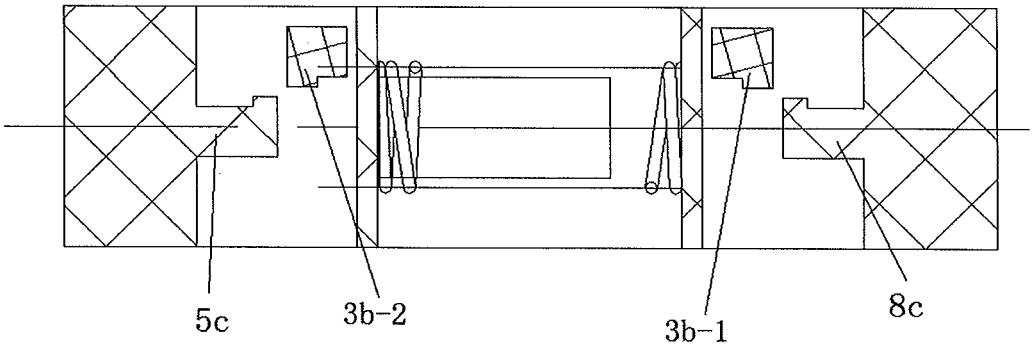
FIG. 7 is a transverse cross-sectional view of FIG. 6.
Figure 8:
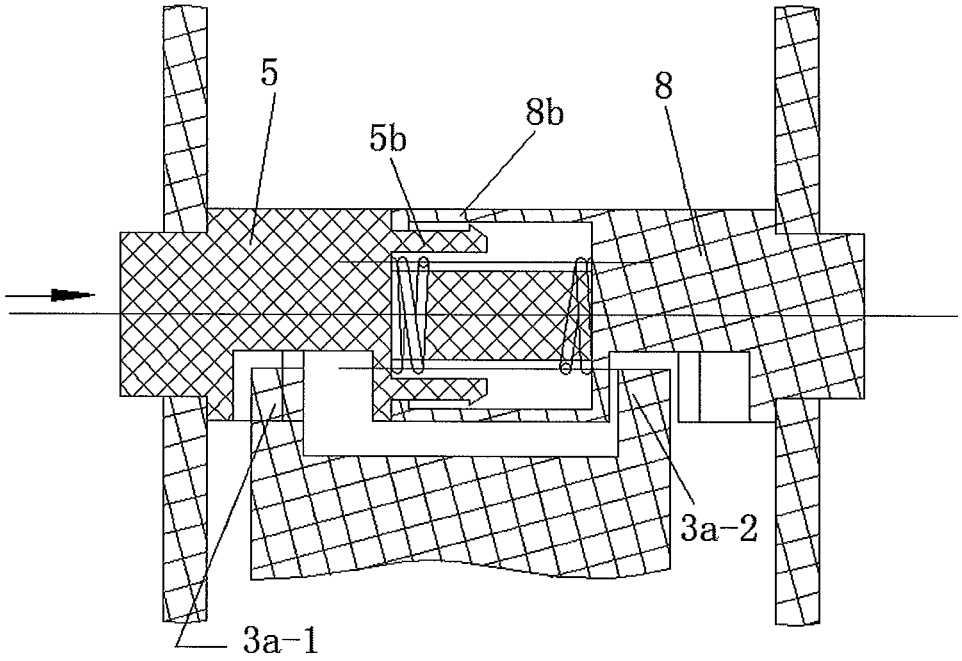
FIG. 8 depicts FIG. 6 after a right push button is pressed down.
Figure 9:
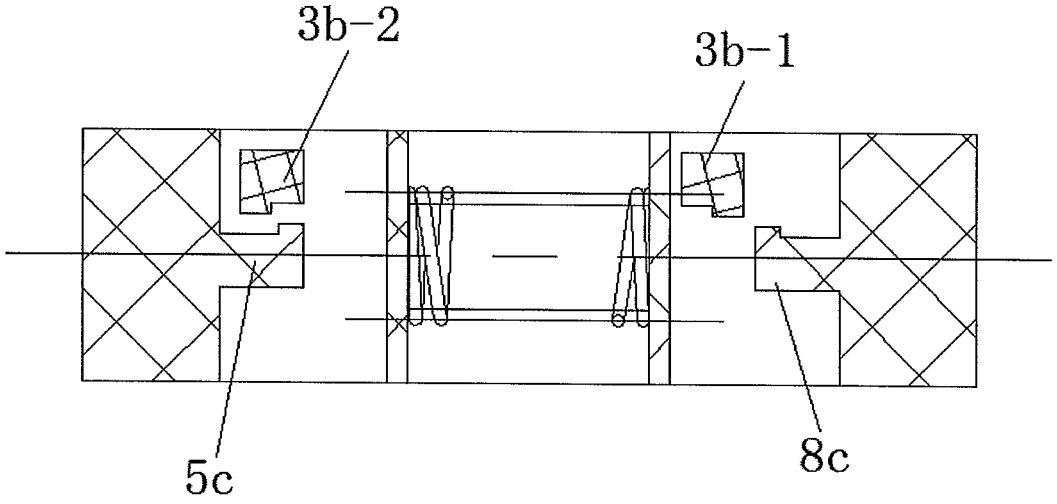
FIG. 9 is a transverse cross-sectional view of FIG. 8.
Figure 10:
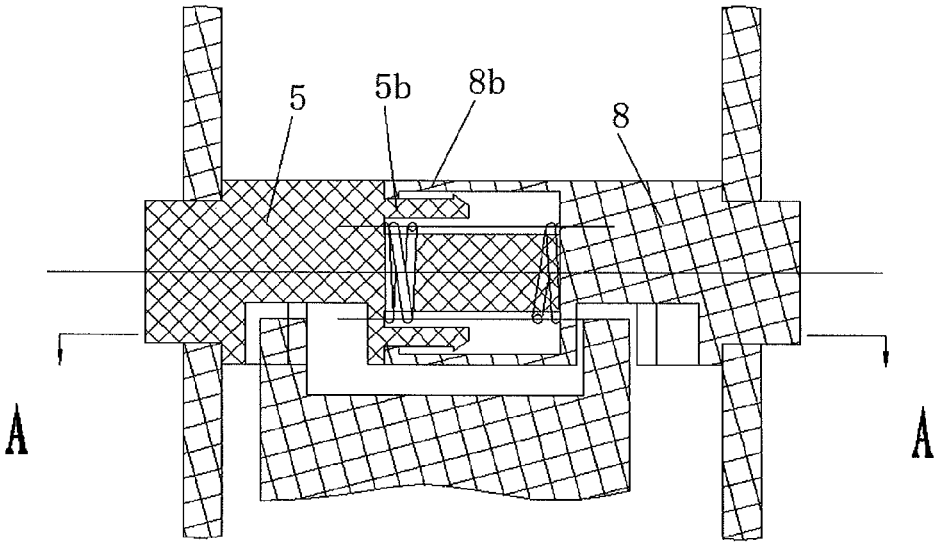
FIG. 10 is a cross-sectional view of a right push button of the working tool of Embodiment 1 in an unlocked state.
Figure 11:
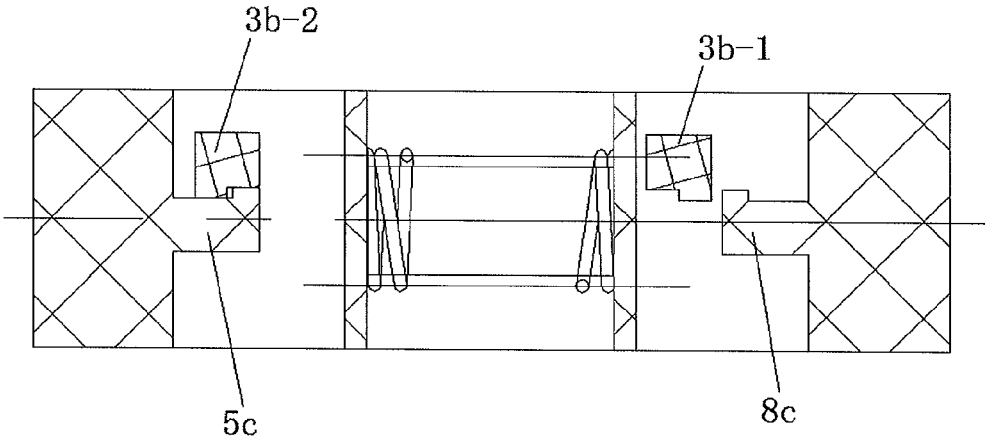
FIG. 11 is a cross-sectional view taken along line A-A of FIG. 10.

Next, the operator further needs to press the lever 3 in the direction as indicated by the arrow in FIG. 5 with the other hand. Generally, the right hand is used for the right-handed operator, and the left hand is used for the left-handed operator. As such, with further reference to both FIG. 6 and FIG. 7, the first extension section 3*a*-1 and second extension section 3*a*-2 move upwards with the lever 3, thus causing the third left engagement portion 3*b*-1 and the third right engagement portion 3*b*-2 to move and stay over the second left engagement portion 8*c* and the second right engagement portion 5*c*, respectively. Then, after the left-handed operator pushes, with the thumb of the left hand, the right push button 5 towards the left push button 8 in the direction as indicated by the arrow in FIG. 8, with further reference to FIG. 9, the second right engagement portion 5*c* will move and stay right under the third right engagement portion 3*b*-2. As such, after the operator releases the lever 3, which is accompanied with the downward movement of the third right engagement portion 3*b*-2 and thereafter its engagement with the second right engagement portion 5*c* as shown in FIG. 10 and FIG. 11, the working tool will maintain an unlocked state without needing the operator to continuously press the lever 3 to keep the working tool in an operational state. It is to be understood that the right-handed operator can also make the working tool maintained in the unlocked state by pushing the left push button 8 towards the right push button 5 with the thumb of the right hand and then following the same subsequent steps, the detailed description of which is omitted for the sake of simplicity.

Furthermore, the operator can shut down the working tool, simply by pushing the lever 3 upwards to cause the third left engagement portion 3*b*-1 or the third right engagement portion 3*b*-2 to move upwards with the lever and thus become disengaged from the corresponding second left engagement portion 8*c* or second right engagement portion 5*c*. After this occurs, affected by the reset spring 6, the second left engagement portion 8*c* or the second right engagement portion 5*c* will be pushed and no longer stay right under the corresponding third left engagement portion 3*b*-1 or third right engagement portion 3*b*-2. As such, after the operator releases the lever 3, the lever 3 will return to the original position with the aid of the torsion spring 2, the first engagement portions 1*a* will again engage with the support portion 3*a*, and the stopper portion 1*b* will be pushed against the fixation member 10*a*, thereby locking the working tool again.

Embodiment 2

Figure 16:
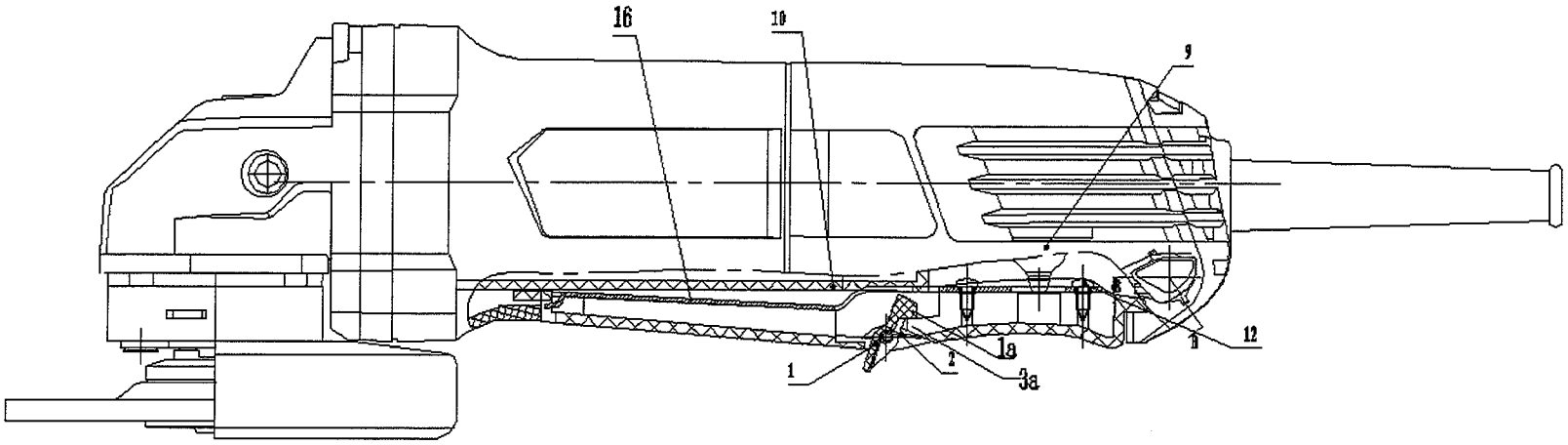
FIG. 16 is a partial schematic cross-sectional view illustrating a working tool in a locked state in accordance with Embodiment 2 of the present invention.
Figure 17:
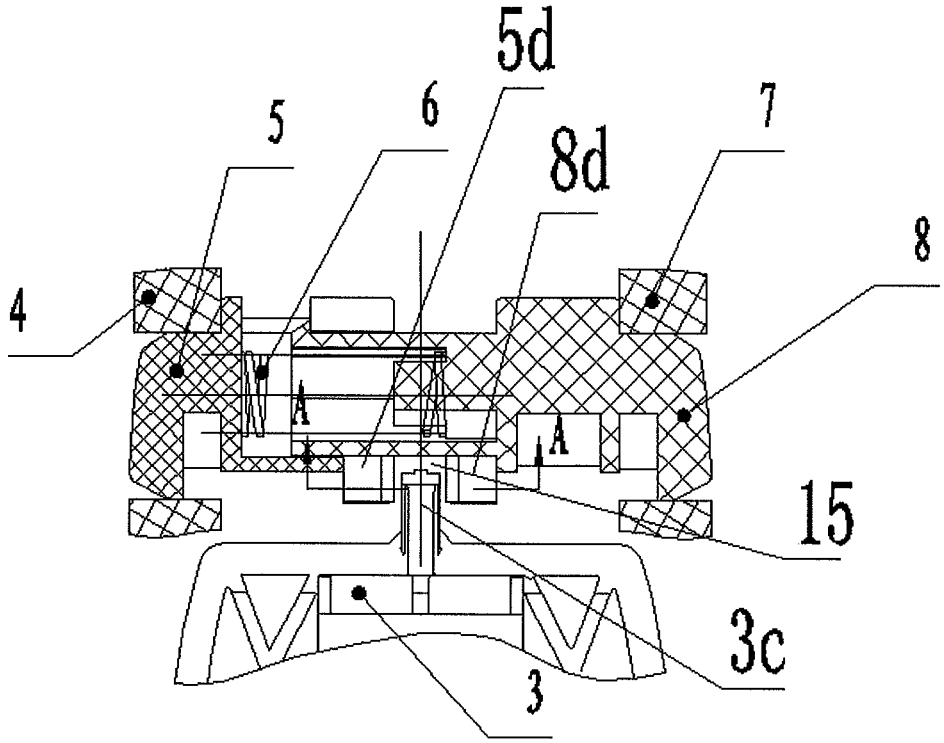
FIG. 17 is a cross-sectional view taken along line B-B of FIG. 16.
Figure 18:
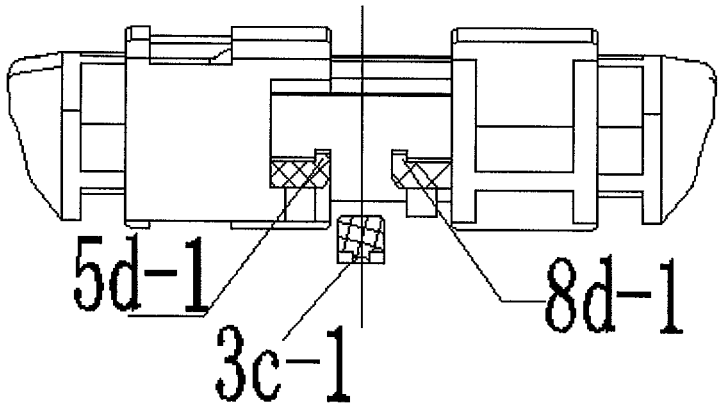
FIG. 18 is a cross-sectional view taken along line A-A of FIG. 17.

As illustrated in FIG. 16, the present embodiment provides a working tool including a housing 10. A working mechanism 11 is disposed on a working portion of the housing 10 and configured to grind or polish a workpiece. The working mechanism 11 is driven to work by a motor disposed within the housing 10. A switch 9 for activating or deactivating the motor is disposed within a handle portion of the housing 10. A lever 3 is disposed under the switch 9 and has one end connected to the housing 10. The lever 3 has a gap formed therein for accommodating a switch lock 1, and the switch lock is disposed in this gap. A resilient shaft is inserted through the switch lock 1 and has its two ends both connected to the lever 3. The resilient shaft is surrounded by a torsion spring 2. The switch lock 1 includes a first portion extending out of the lever 3 and a second portion hiding in the housing 10. The second portion of the housing 10 has a first engagement portion defined thereon, and the lever 3 has a support portion 3*a* proximal to and engageable with the first engagement portion 1*a*. With additional reference to FIGS. 17 and 18, the handle portion of the housing 10 is provided with a left push button 8 and a right push button 5 partially inserted therein from the left side and right side, respectively. The left push button 8 and the right push button 5 each has a first end horizontally protruding out of the housing 10 to act as a manipulation portion and a rest portion including a main body and a second end hiding in the housing 10. The second end of the left push button 8 slidably fits in the second end of the right push button 5, thereby allowing the left push button 8 to move horizontally towards the right push button 5 and the right push button 5 to move horizontally towards the left push button 8. A reset mechanism is interconnected between the second ends of the left push button 8 and right push button 5. The left push button 8 has a first extension portion 8*d* extending towards the lever 3 and the right push button 5 has a second extension portion 5*d* extending towards the lever 3. The first extension portion 8*d* has an end portion defining a fourth engagement portion 8*d*-1, and the second extension portion 5*d* has an end portion defining a fifth engagement portion 5*d*-1. The fourth engagement portion 8*d*-1 and the fifth engagement portion 5*d*-1 are spacedly disposed opposing each other to form an engagement gap 15 between the first extension portion 8*d* and the second extension portion 5*d*. The lever 3 has a fifth extension section 3*c* extending towards and partially inserted in the engagement gap 15. The fifth extension section 3*c* has a sixth engagement portion 3*c*-1 in the engagement gap 15 and engageable with the fourth engagement portion 8*d*-1 or the fifth engagement portion 5*d*-1.

Referring back to FIG. 1, when the working tool is in a locked state, the sixth engagement portion 3*c*-1 is disengaged from both of the fourth engagement portion 8*d*-1 and the fifth engagement portion 5*d*-1.

Figure 19:
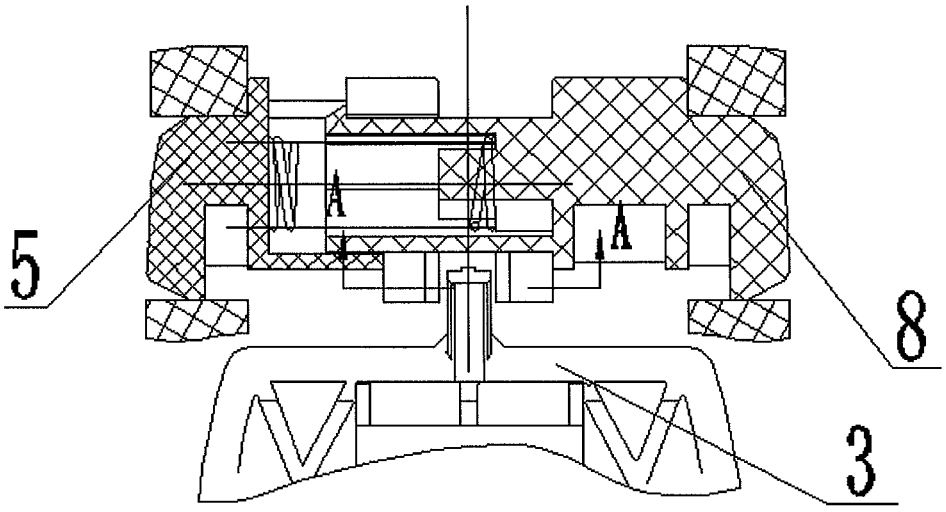
FIG. 19 depicts FIG. 17 and FIG. 18 after a lever moves upwards.
Figure 20:
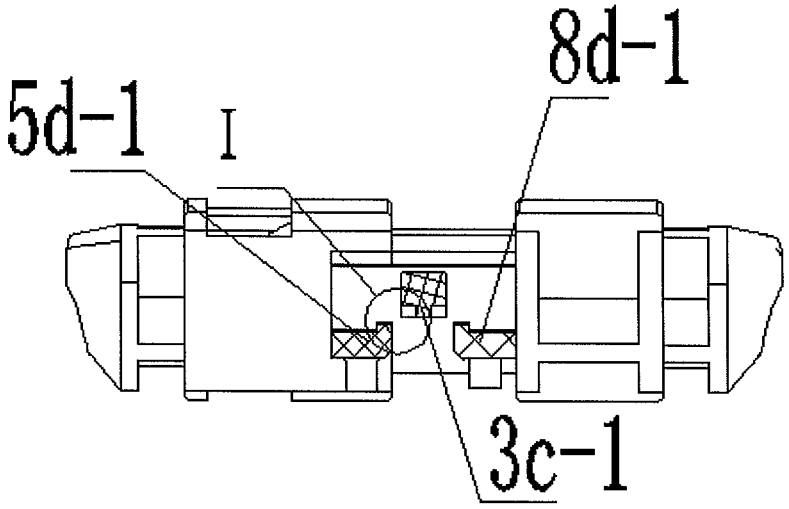
FIG. 20 is a cross-sectional view taken along line A-A of FIG. 19.
Figure 21:
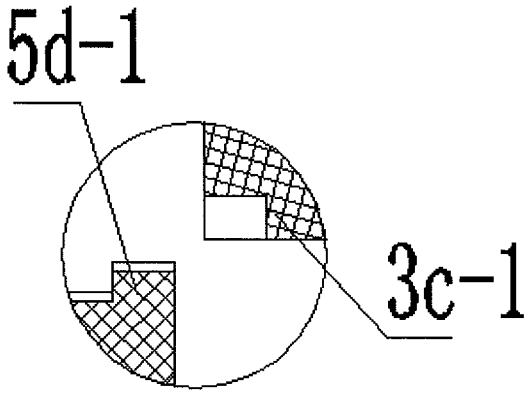
FIG. 21 is an enlarged view of part I of FIG. 20.
Figure 22:
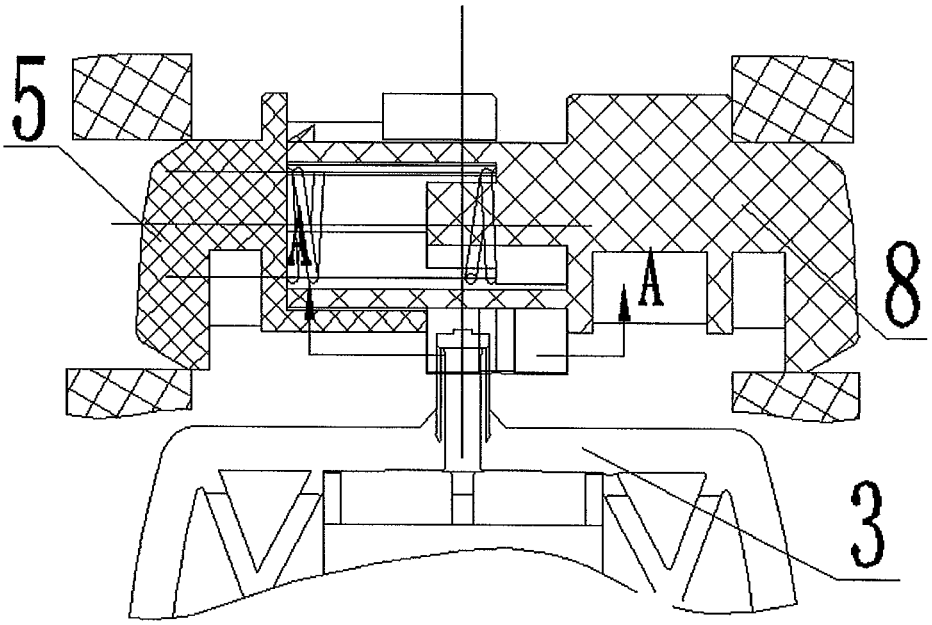
FIG. 22 depicts FIG. 17 and FIG. 18 after a right push button is pushed inwardly.
Figure 23:
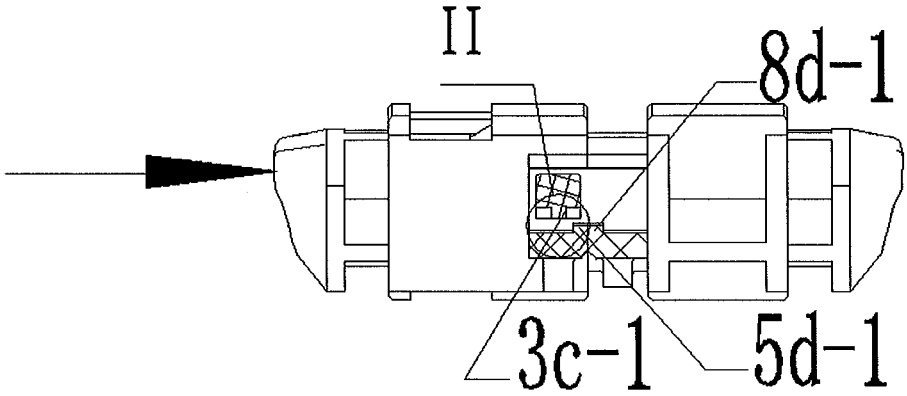
FIG. 23 is a cross-sectional view taken along line A-A of FIG. 22.
Figure 24:
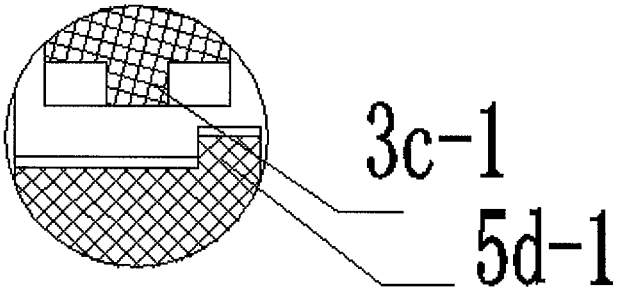
FIG. 24 is an enlarged view of part II of FIG. 23.
Figure 25:
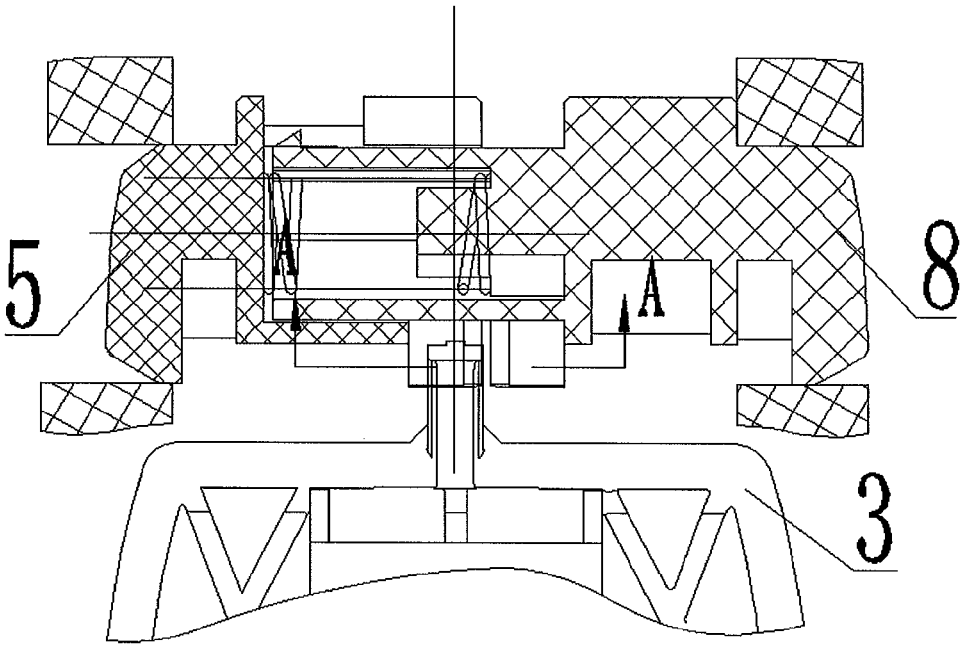
FIG. 25 depicts FIG. 17 and FIG. 18 after the engagement between engagement portions.
Figure 26:
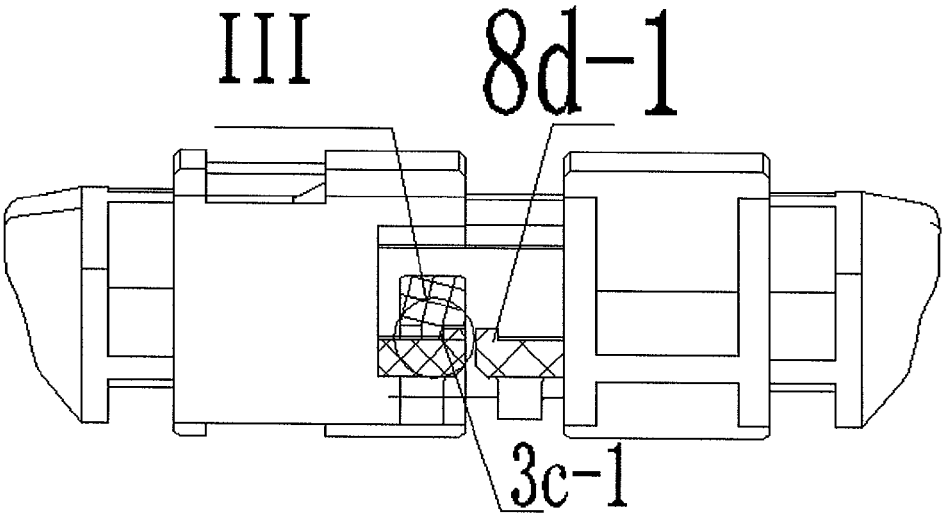
FIG. 26 is a cross-sectional view taken along line A-A of FIG. 25.
Figure 27:
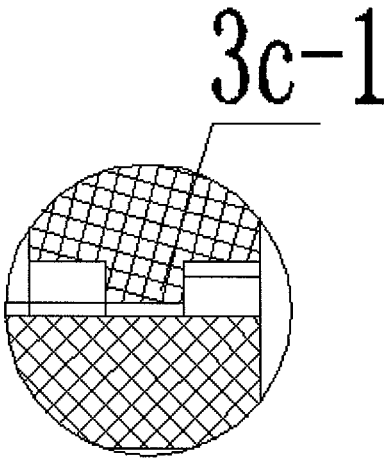
FIG. 27 is an enlarged view of part III of FIG. 26.

As shown in FIGS. 19 to 21, when to unlock the working tool, an operator needs to first push the lever 3 upwards to cause the sixth engagement portion 3*c*-1 to move and stay over the fourth engagement portion 8*d*-1 and the fifth engagement portion 5*d*-1. Next, with further reference to FIGS. 22 to 24, the operator further needs to inwardly push the right push button 5 or the left push button 8 to cause the fourth engagement portion 8*d*-1 or the fifth engagement portion 5*d*-1 to move towards and stop right under the sixth engagement portion 3*c*-1. As such, with further reference to FIGS. 25 to 27, after the operator releases the lever 3, the sixth engagement portion 3*c*-1 moves downwards and engages with the fourth engagement portion 8*d*-1 or the fifth engagement portion 5*d*-1.

The rest of this embodiment has the same structure and works in the same way as that described in Embodiment 1.

What is claimed is:

1. A working tool, comprising: a housing;

a working mechanism disposed on a working portion of the housing and configured to grind or polish a workpiece, the working mechanism driven to work by a motor disposed within the housing;

a switch disposed within a handle portion of the housing and configured to activate or deactivate the motor; and a lever disposed under the switch and having a first end connected to the housing, wherein the lever has a gap formed therein for accommodating a switch lock, the switch lock having a rotating shaft inserted therethrough, the rotating shaft having two ends both connected to the lever and surrounded by a torsion spring, the switch lock including a first portion extending out of the lever and a second portion hiding in the housing, wherein the second portion of the switch lock has a first engagement portion defined on a first side and a stopper portion defined on a second side thereof, the lever having a support portion proximal to and engageable with the first engagement portion, wherein the handle portion of the housing has a left push button and a right push button partially inserted therein from a left side and a right side, respectively, the left push button and the right push button each having a first end horizontally protruding out of the housing to act as a manipulation portion and a main body and a second end hiding in the housing, the second end of the left push button slidably fitting in the second end of the right push button to allow the left push button to move horizontally towards the right push button and the right push button to move horizontally towards the left push button, the second ends of the left push button and right push button having a reset mechanism interconnected therebetween, wherein the main bodies of the left push button and the right push button in the housing are formed with a first groove and a second groove, respectively, the lever having a first extension section and a second extension section formed at a second end thereof in correspondence with the positions of the first groove and the second groove, respectively, the first extension section and the second extension section extending in the first groove and the second groove, respectively, each of the first groove and the second groove having a second engagement portion formed on a groove wall thereof, each of the first extension section and the second extension section being provided with, at a side facing a corresponding second engagement portion, a third engagement portion engageable with the corresponding second engagement portion, wherein when the working tool is in a locked state, the first engagement portion engages with the support portion, the stopper portion being pushed against a fixation member disposed in the housing, each second engagement portion being disengaged from the corresponding third engagement portion, and wherein when the working tool is in an unlocked state, the first engagement portion is disengaged from the support portion, the stopper portion being apart from the fixation member, the second engagement portion on the first groove engaging with the third engagement portion on the first extension portion or the second engagement portion on the second groove engaging with the third engagement portion on the second extension portion.

2. The working tool of claim 1, wherein the second end of the left push button defines third extension sections each formed with a first sliding groove, and the second end of the right push button defines fourth extension sections each formed with a second sliding groove, wherein each of the third extension sections has an end portion horizontally slidably disposed in a corresponding second sliding groove, and each of the fourth extension sections has an end portion horizontally slidably disposed in a corresponding first sliding groove, wherein the end portions of the third extension sections and the end portions of the fourth extension sections are hooked up when the working tool is in a locked state, and the reset mechanism is disposed in a space defined by the third extension sections and the fourth extension sections.

3. The working tool of claim 1, wherein the reset mechanism comprises a reset spring and a protrusion extending from a central area of the second end of the left push button towards the right push button, wherein the reset spring surrounds the protrusion.

4. The working tool of claim 1, wherein the working mechanism comprises a grinding wheel and a guard securing means disposed spacedly around the grinding wheel, the grinding wheel being driven by the motor to rotate, and wherein the guard securing means comprises: a guard disposed around the grinding wheel and a front cover coupled to the housing, the guard provided with a snap ring axially extending from a surface of the guard opposite to the grinding wheel in a direction departing from the grinding wheel, the snap ring formed with one or more protrusions on the inner surface, a top portion of the front cover defining one or more recesses a number of which is equal to a number of the one or more protrusions, the front cover defining an outer circumstantial surface formed with an annular groove, the one or more protrusions of the snap ring fitting in the annular groove with an aid of the one or more recesses, the snap ring and the front cover sandwiching a portion of a wrench and leaving a hanging tongue of the wrench outside, the snap ring formed with stop notches, the portion of the wrench sandwiched between the snap ring and the front cover formed with a stop cog engaging with one of the stop notches.

5. A working tool, comprising:

a housing;

a working mechanism disposed on a working portion of the housing and configured to grind or polish a workpiece, the working mechanism driven to work by a motor disposed within the housing;

a switch disposed within a handle portion of the housing and configured to activate or deactivate the motor; and a lever disposed under the switch and having a first end connected to the housing, wherein the lever has a gap formed therein for accommodating a switch lock, the switch lock having a resilient shaft inserted therethrough, the resilient shaft having two ends both connected to the lever and surrounded by a torsion spring, the switch lock including a first portion extending out of the lever and a second portion hiding in the housing, wherein the second portion of the switch lock has a first engagement portion defined thereon, and the lever has a support portion proximal to and engageable with the first engagement portion, wherein the handle portion of the housing has a left push button and a right push button partially inserted therein from a left side and a right side, respectively, the left push button and the right push button each having a first end horizontally protruding out of the housing to act as a manipulation portion and a main body and a second end hiding in the housing, the second end of the left push button slidably fitting in the second end of the right push button to allow the left push button to move horizontally towards the right push button and the right push button to move horizontally towards the left push button, the second ends of the left push button and right push button having a reset mechanism interconnected therebetween, wherein the left push button has a first extension portion extending towards the lever and the right push button has a second extension portion extending towards the lever, the first extension portion having an end portion defining a fourth engagement portion and the second extension portion having an end portion defining a fifth engagement portion, the fourth engagement portion and the fifth engagement portion spacedly disposed opposing each other to form an engagement gap between the first extension portion and the second extension portion, the lever having a fifth extension section extending towards and partially inserted in the engagement gap, the fifth extension section having a sixth engagement portion in the engagement gap and engageable with the fourth engagement portion or the fifth engagement portion, wherein when the working tool is in a locked state, the first engagement portion engages with the support portion, and the sixth engagement portion is disengaged from both of the fourth engagement portion and the fifth engagement portion, and wherein when the working tool is in an unlocked state, the first engagement portion is disengaged from the support portion, and the sixth engagement portion engages with the fourth engagement portion or the fifth engagement portion.

6. The working tool of claim 5, wherein the reset mechanism comprises a reset spring and a spring holder, the reset spring surrounding the spring holder, the spring holder being connected to the second end of the right push button or the second end of the left push button.

7. The working tool of claim 5, wherein the working mechanism comprises a grinding wheel and a guard securing means disposed spacedly around the grinding wheel, the grinding wheel being driven by the motor to rotate, and wherein the guard securing means comprises:

a guard disposed around the grinding wheel and a front cover coupled to the housing, the guard provided with a snap ring axially extending from a surface of the guard opposite to the grinding wheel in a direction departing from the grinding wheel, the snap ring formed with one or more protrusions on the inner surface, a top portion of the front cover defining one or more recesses a number of which is equal to a number of the one or more protrusions, the front cover defining an outer circumstantial surface formed with an annular groove, the one or more protrusions of the snap ring fitting in the annular groove with an aid of the one or more recesses of the front cover, the snap ring and the front cover sandwiching a portion of a wrench and leaving a hanging tongue of the wrench outside, the snap ring formed with stop notches, the portion of the wrench sandwiched between the snap ring and the front cover formed with a stop cog and the stop cog engaging with one of the stop notches.

8. The working tool of claim 5, wherein the housing and the lever have a handle reinforcement plate formed therebetween and the handle reinforcement plate fixedly coupled to the lever.

* * * * *